United States Patent [19]

Abernethy

[11] 4,335,929

[45] Jun. 22, 1982

[54] LINE ASSIGNMENT MODULE

[75] Inventor: Lynn W. Abernethy, Advance, N.C.

[73] Assignee: AMP Incorporated, Harrisburg, Pa.

[21] Appl. No.: 147,030

[22] Filed: May 6, 1980

[51] Int. Cl.[3] ..... H01R 11/20; H01R 13/518

[52] U.S. Cl. ..... 339/97 R; 339/18 R; 339/154 A; 339/176 M

[58] Field of Search ..... 339/18 R, 97 R, 147 R, 339/159 R, 159 A, 176 M; 179/1 PC

[56] References Cited

U.S. PATENT DOCUMENTS

| | | | |
|---|---|---|---|
| T958,009 | 5/1977 | Snyder | 339/99 R |
| 2,356,752 | 8/1944 | Deysher | 173/330 |
| 3,227,989 | 1/1966 | Wilm et al. | 339/18 R |
| 3,829,821 | 8/1974 | Derr et al. | 339/91 R |
| 3,997,234 | 12/1976 | Worman | 339/105 |
| 4,018,997 | 4/1977 | Hoover et al. | 179/98 |
| 4,070,548 | 1/1978 | Kasper | 179/1 PC |
| 4,239,317 | 12/1980 | Hesse et al. | 179/1 PC X |

FOREIGN PATENT DOCUMENTS

| | | |
|---|---|---|
| 1690230 | 9/1971 | Fed. Rep. of Germany . |
| 2600381 | 7/1976 | Fed. Rep. of Germany . |

*Primary Examiner*—Eugene F. Desmond
*Attorney, Agent, or Firm*—Gerald K. Kita

[57] ABSTRACT

A module is disclosed in kit form for tapping off selected telephone lines from a receptacle connector connected to respective conductors of a telephone cable. A face plate is mounted over the receptacle connector. The face plate includes plural plug receiving openings opening into a plug receiving cavity of the connector. A two piece plug having opposed pairs of plug contact terminals is insertable through a selected opening of the face plate to connect the plug contact terminals with the receptacle contact terminals. A telephone jack approved for use in the National Telephone Network is provided with insulated electrical leads which are connected to the plug contact terminals.

5 Claims, 10 Drawing Figures

10
12
8
22
28
24
24
30
32
34
6
14
26
26
20
4
2
1
18
16

50
48
52
54
56
74
78
66
72
64
34
70
68
6
30
32
58
46
36
60
38
40
44
42
62

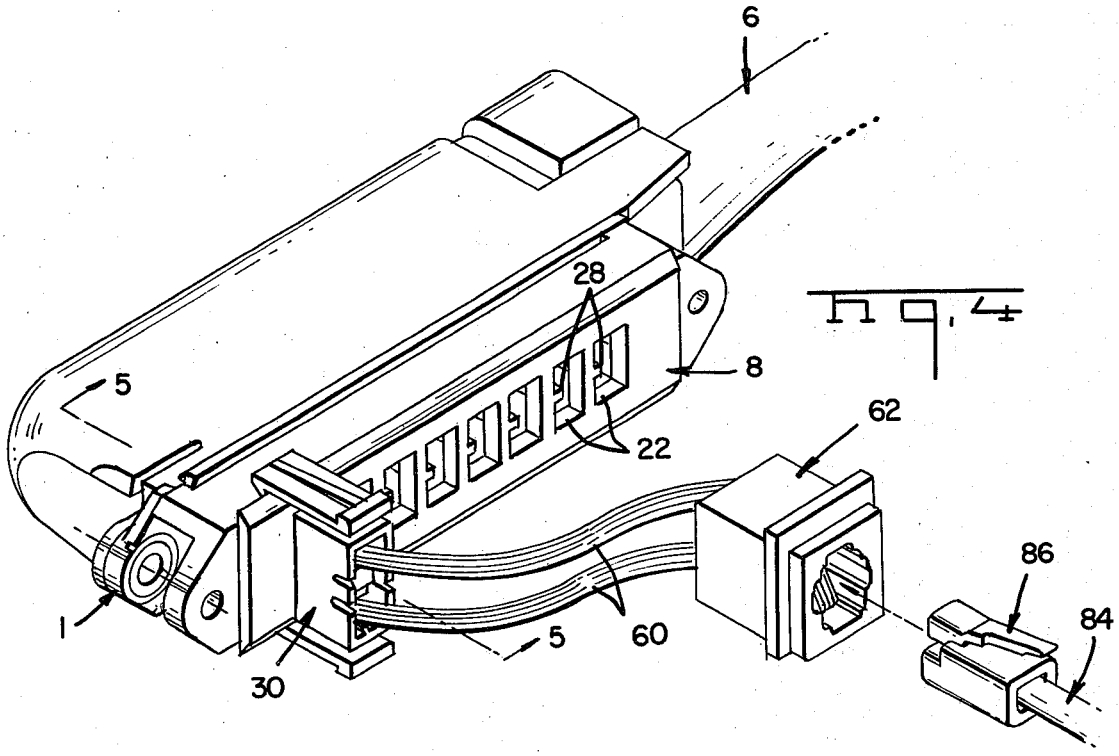
Fig. 4
Fig. 5
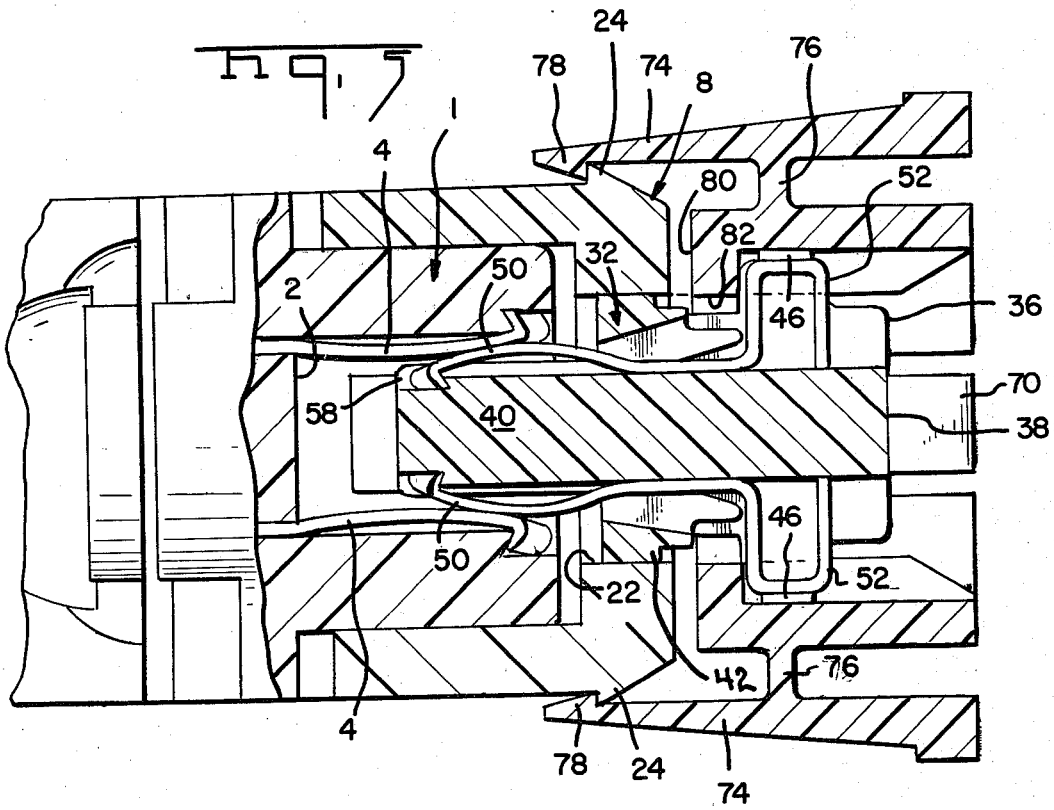

LINE ASSIGNMENT MODULE

FIELD OF THE INVENTION

The invention relates to utilization of a standard telephone jack approved for use by the National Telephone Network and a tap of multiple telephone lines.

BACKGROUND OF THE INVENTION

A telephone cable typically consists of 25 pairs of insulated conductors terminated with respective contact terminals contained in an electrical connector, as disclosed in U.S. Pat. No. 3,760,335. A telephone hand set requires a line cord consisting of 2 pairs of telephone lines or 3 pairs or 4 pairs. The line cord is terminated at each end with a miniature telephone plug, such as disclose in U.S. Pat. No. 3,860,316. The telephone plug is intermated in a miniature telephone jack of the type disclosed in U.S. Pat. No. 3,850,497. There has been a need for a kit of parts which will connect a miniature telephone receptacle into a 25 pair connector of a telephone cable.

SUMMARY OF THE INVENTION

The present invention is directed to a miniature plug module into which electrical conductor leads of a miniature telephone jack is connected. A face plate having plural, plug receiving openings is mounted over the 25 pair connector of a telephone cable. The plug module is selectively inserted through one of the openings of the face plate for connection to selected pairs of contact terminals of the 25 pair connector. A closure box contains the interconnected connectors, and is provided with a panel opening in which the miniature telephone jack is mounted.

An object of the present invention is to provide a telephone, line assignment module which connects a miniature line cord jack with selected pairs of contact terminals in a 25 pair connector.

Another object is to provide an enclosure box for a 25 pair telephone cable connector, a line cord miniature jack and a line assignment module for interconnecting the jack with selected pairs of contact terminals of the 25 pair connector.

Other objects and many attendant advantages of the present invention will become apparent from the following detailed description taken in conjunction with the accompanying drawings.

DESCRIPTION OF THE ACCOMPANYING DRAWINGS

FIG. 4 is an enlarged fragmentary perspective of the plug and jack shown in FIG. 3, assembled to the face plate mounted over the 25 pair connector. Additionally, the figure illustrates a telephone line cord terminated with a miniature plug for connection into the jack.

FIG. 5 is an enlarged fragmentary elevation in section taken along line 5—5 of FIG. 4.

DETAILED DESCRIPTION

Figure 1:
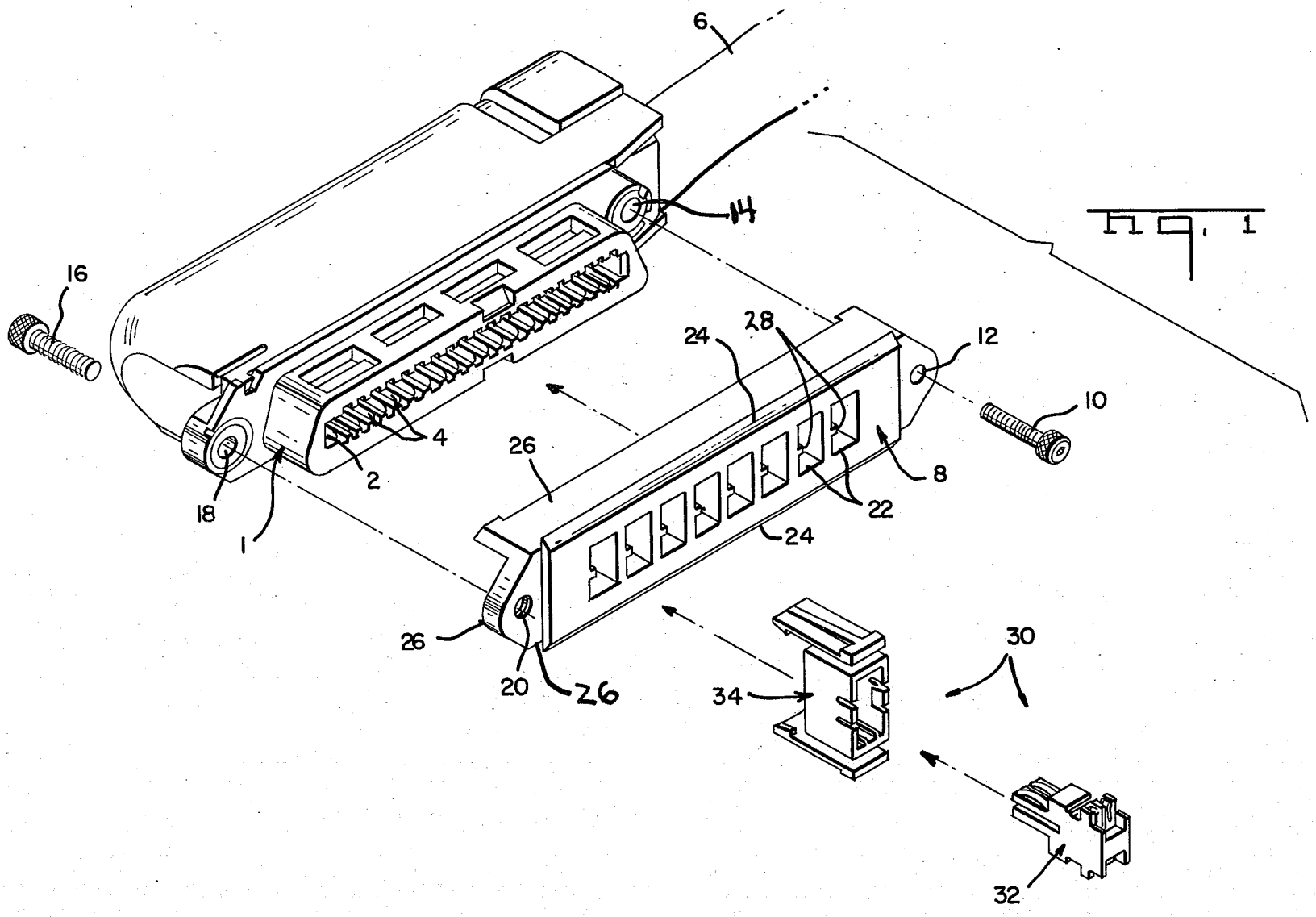
FIG. 1 is an enlarged fragmentary perspective with parts exploded of a 25 pair telephone cable terminated with a 25 pair connector, a face plate for mounting over the connector and a line assignment module for interconnection into one of the module receiving openings of the face plate.

With more particular reference to FIG. 1 of the drawings, there is shown generally at 1 a 25 pair, receptacle electrical connector such as disclosed in U.S. Pat. No. 3,760,335, having a plug receiving cavity 2 in which are provided 25 pairs of opposed contacts 4 terminated to respective insulated conductors of a 25 pair telephone cable generally shown at 6. A molded plastic face plate is shown generally at 8, adapted for mounting over the cavity 2 of the connector 1 by a first threaded fastener 10 passing through a first bore 12 through the face plate for threaded connection in a threaded recess 14 of the connector 1. Additionally, a second threaded fastener 16 passes through a bore 18 of the connector 1 and is secured in a threaded bore 20 of the face plate 8. The face plate is provided with a row of plug receiving openings 22 which communicate with the cavity 2. A parallel pair of lip flanges 24 are parallel to, and on opposite sides of, the row of openings 22. The face plate 8 also is provided with a pair of elongated parallel side walls 26 for overlying respective sides of the connector 1. Each opening 22 is provided with projecting rib 28 which extends from the face plate 8 toward the connector cavity 2.

Figures 2, 3, 6, 8:
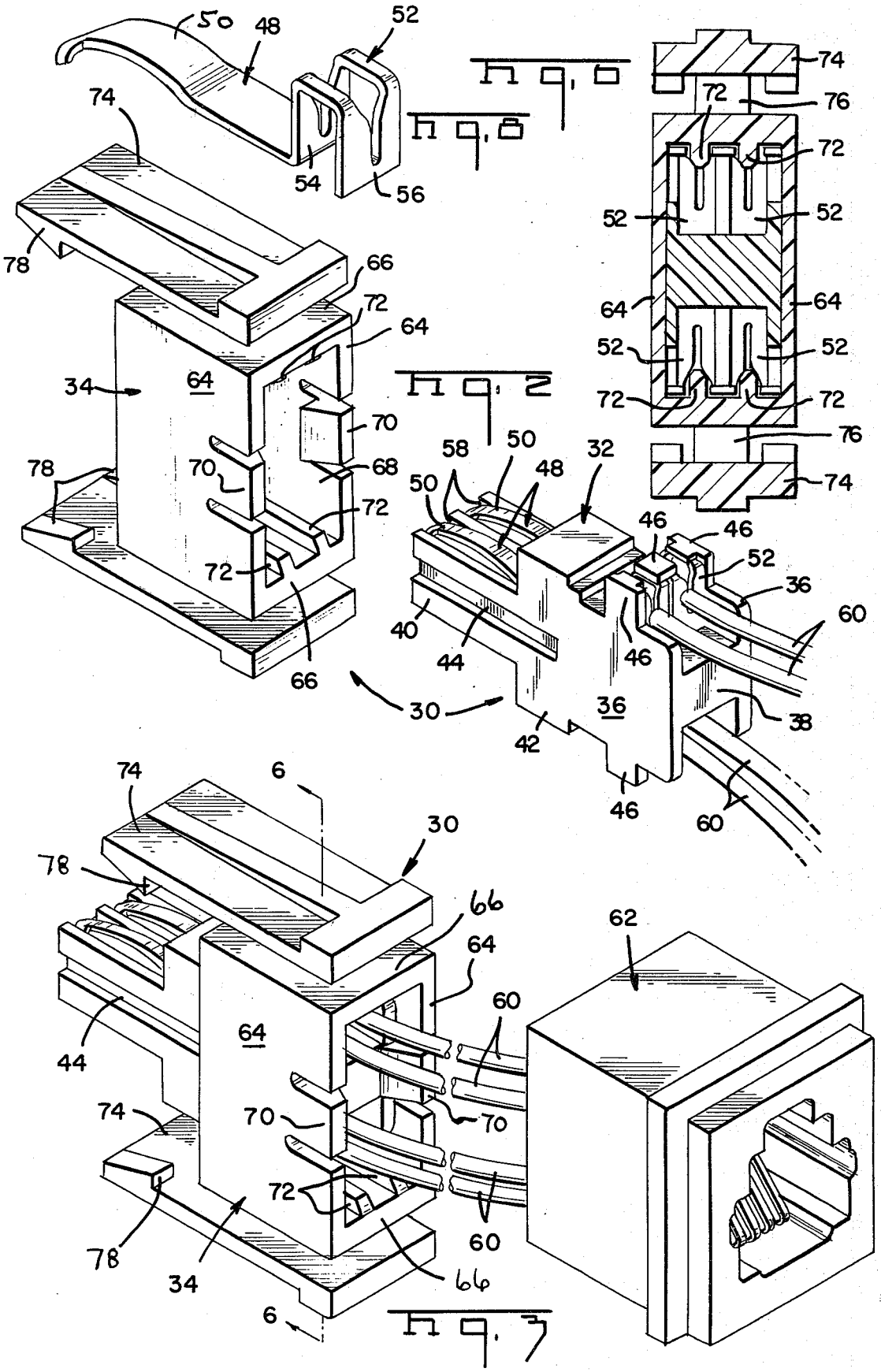
FIG. 2 is an enlarged fragmentary perspective of a two piece line assignment module with parts exploded.
FIG. 3 is an enlarged fragmentary perspective of a plug of the module of FIG. 2 with parts assembled together with a miniature, telephone line cord jack.
FIG. 6 is an enlarged elevation in section taken along line 6—6 of FIG. 3.
FIG. 8 is a perspective of a plug contact terminal.

FIGS. 1, 2, and 3 illustrate a two piece, line assignment module 30 comprising a plug member 32 and a plug receiving cavity 34. The plug member 32 is illustrated in greater detail in FIG. 2, and includes a molded plastic body provided with side walls 36 interconnected by an end wall 38. The opposite end of the plug member 32 is provided with a projecting, male connecting end 40 integral with a stepped enlarged section 42. A keying groove 44 is recessed into one of the side walls 36, and extends from the outer most tip of the end 40 and along the enlarged section 42. The plug further is molded with projecting partitions 46 distributed in a pair of rows which extend between the side walls 36. The rows of partitions project in opposite directions from the remainder of the plug 42.

As shown in FIG. 8 a stamped and formed, plug contact terminal is illustrated generally at 48, and is provided with a resilient finger portion 50 integral with an inverted, U-shaped conductor terminating portion 52 having a pair of plates 54 and 56 interconnected by a bight and provided with a common slot. The slot width in the plate 54 is sufficiently narrow to slice through the insulation of an insulated conductor and resiliently grip opposite sides of the conductor to establish an electrical connection. The slot width in the plate 56 is slightly larger, to resiliently grip opposite sides of the insulated conductor and provide a strain relief. Further details of the contact terminal 52 are similar to those of the terminal disclosed in U.S. Pat. No. 3,760,335.

Opposed pairs of contacts 48 are assembled to the plug member 32, with the finger portions 50 lying in grooves 58 in opposite sides of the plug end 40, and with the wire terminating portions 52 being supported between the partitions 46. Insulated conductors 60 are terminated to respective wire terminating portions 52. As shown in FIG. 3, the conductors 60 may comprise the insulated wire leads from the contact terminals of a miniature telephone, line cord jack illustrated at 62. The telephone jack is a standard design approved for use in the National Telephone Network. Details of the jack are disclosed in the aforesaid U.S. Patent.

FIGS. 2 and 3 more particularly show the molded plastic, plug receiving housing 34 having side walls 64 interconnected by end walls 66. An internal cavity 68 is defined by the walls 64 and 66. The walls 66 are molded with L-shaped latching fingers 70 which project into the cavity 68. The end walls 66 are provided with parallel ribs 72 which project into the cavity 68. An outer latching arm 74 is secured to each wall 66 by a stem 76, shown in FIG. 5. The tips of the arms 74 are provided with projecting, latching shoulders 78 which are inwardly directed, toward the other arm 74. The arms 74 are relatively large in area so as to be readily grasped between a person's thumb and forefinger. Further as shown in FIG. 5, the shoulders 78 project outwardly past a back wall 80 interconnecting the housing side walls 64. The back wall has a central opening 82 therethrough.

As shown in FIGS. 2, 3, and 6, the plug member 32 is assembled with the housing 34 by inserting the end 40 of the plug member into the housing cavity 68. The latching arms 70 are resiliently deflected outwardly of the cavity 68 by the plug member 32 during its insertion. Following complete insertion of the plug member, the latching arms 70 will latchably engage against the end wall 38 of the plug member 32 to retain the same in the cavity 68. The plug member portions 40 and 42 will pass through the opening 82 in the back wall 80. The partitions 46 will remain inside the cavity 68 in registration against the back wall 82. The housing ribs 72 partially enter respective slots in the bights of each wire terminating portion 52, covering respective conductors 60 and preventing their pullout from respective slots.

As shown in FIGS. 4 and 5, the end 40 of each plug member is inserted through a selected opening 22 of the face plate 8, and then into the cavity 2 of the receptacle connector 1. The resilient finger portions 50 of the plug contact terminals 48 resiliently engage respective, receptacle contact terminals 4 to establish electrical connections therewith. The plug member section 42 mateably interfits within the confines of the face plate opening 22. The keying groove 44 must be aligned with the rib 28 of the opening 22 to permit insertion of the plug member. The latching arms 74 overlie the flanges 24 of the face plate 8, and the shoulders 78 of the latching arms latch behind the flanges 24 to retain the module 30 in position. The completed assembly thereby taps selected conductors of the cable 6 for connection with the contact terminals of the jack 62 which provides a connection for a telephone line cord generally shown in FIG. 4 at 84, the conductors of which are terminated with a miniature plug 86 of the type approved for use in the National Telephone Network, and disclosed, for example, in U.S. Pat. No. 3,860,316.

Figure 7:
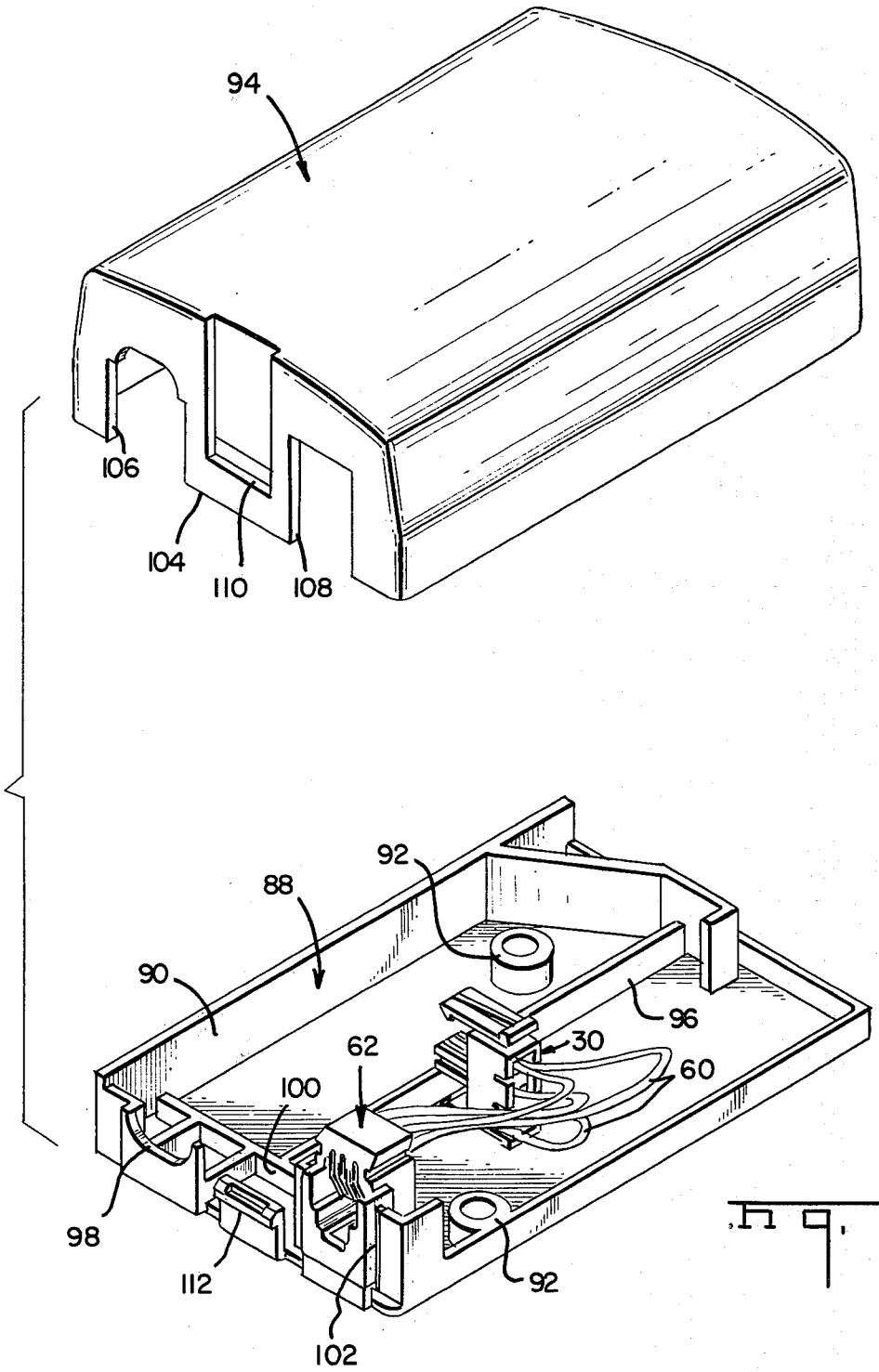
FIG. 7 is an enlarged perspective of a closure box for the component parts assembled together as shown in FIG. 4.

FIG. 7 illustrates a closure box, which includes a molded plastic base 88 having an internal cavity 90 with projecting bosses 92 which are bored to receive fasteners, not shown, to secure the base to a wall, floor, or panel surface. A molded, generally inverted, dome shaped cover 94 cooperates with the base 88 to enclose the connector 1, the module 30, the leads 60 and the jack 62 therein. More particularly, the connector 1 is placed inside the cavity 90. The base 88 is molded with a central rail 96 which supports the connector 1. The cable 6 of the connector is laid into an inverted yoke collar 98 molded in a side wall 100 of the base 88. The jack 62 is mounted in a slotted opening 102 of the wall 100 so that the plug receiving cavity of the jack 62 faces outwardly of the base cavity 90. The cover 94 includes a side wall 104 which is molded with an inverted cut out 106 which slidably receives both the cable 6 and the yoke collar 98 therein. Another inverted cut out 108 in the cover wall 104 is received over a portion of the jack 62. A recessed shoulder 110 in the cover wall 104 provides a catch for a generally hook shaped latch 112 molded on the base 88.

Figure 9:
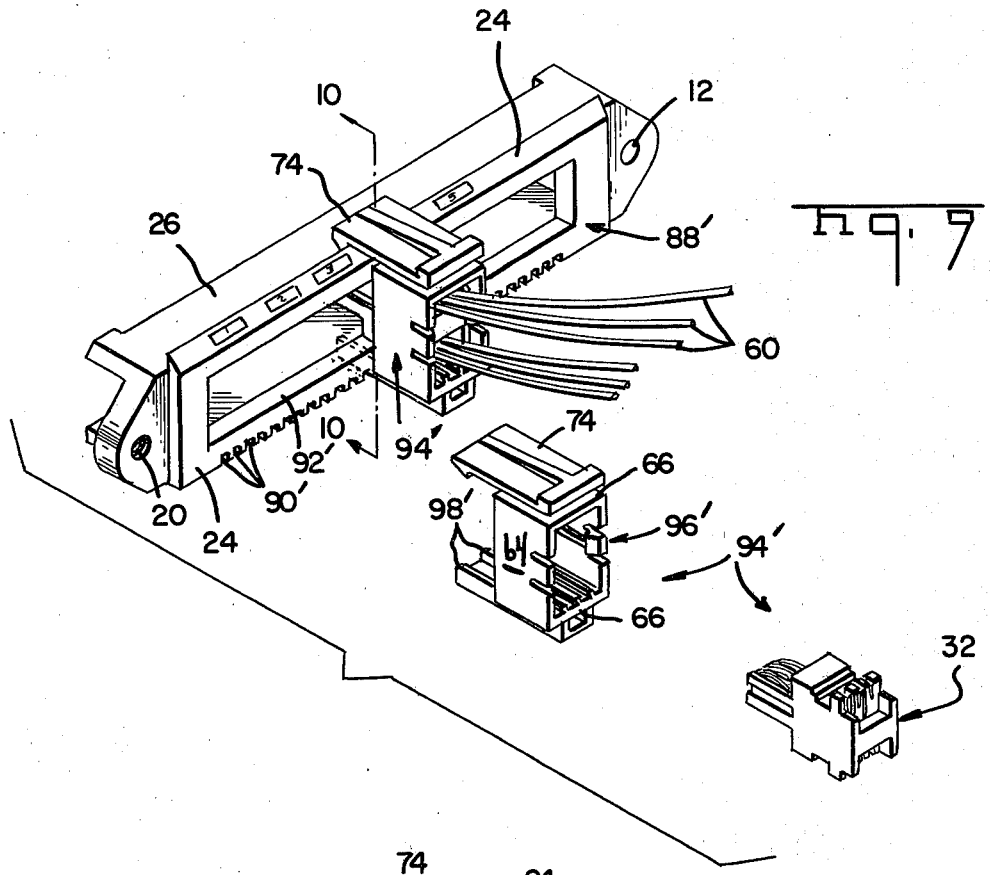
FIG. 9 is a perspective view, partly exploded of modified line assignment modules and a modified face plate.
Figure 10:
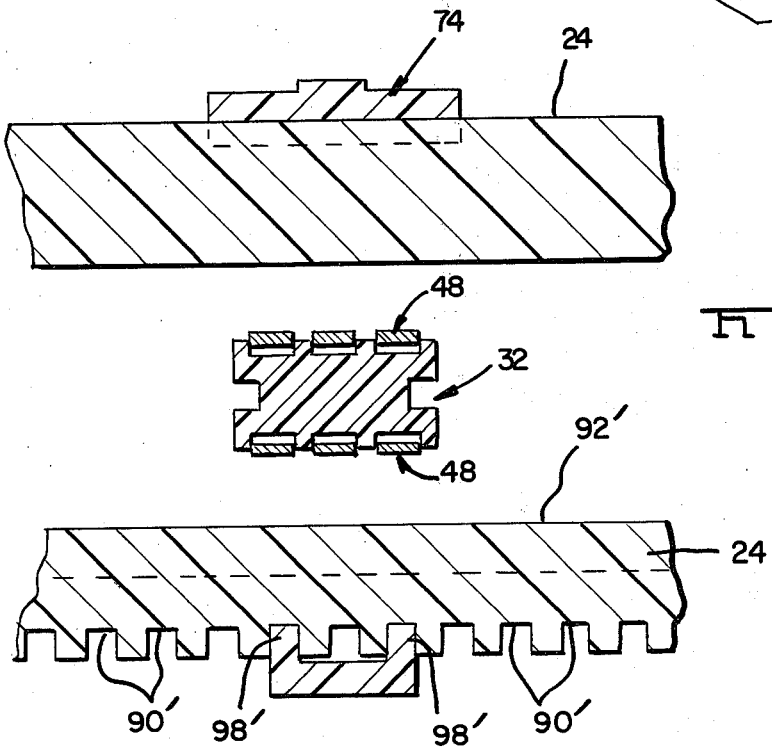
FIG. 10 is an enlarged cross-sectional view taken along lines 10—10 of FIG. 9, with parts omitted.

FIG. 9 is a perspective, and FIG. 10 is an enlarged section along the line 10—10 of FIG. 9, of another embodiment of a faceplate 88' similar to the faceplate 8, with like parts of the faceplates 88' and 8 designated with like numerals. The one flange 24 of the faceplate 88' is provided with a series of keyways 90' extending toward the receptacle cavity 2 over which the faceplate 88' is mounted as an alternative to faceplate 8. The faceplate 88' is provided with an elongated, continuous, plug receiving opening 92' instead of the openings 22 in the faceplate 8. A module 94', similar to the module 30, is illustrated, with like parts of the modules 94' and 30 designated with like numerals. The plug member 32 is the same for each module 30 and 94'. A housing 96' of the module 94' is similar to the housing 34 except that only one latching arm 74 is provided. A pair of elongated, rib like, keys 98' are aligned with corresponding keyways 90' to guide the housing member 64 when the assembled module 94' is plugged into the opening 92' of the faceplate 88' and the plug member 32 is plugged into the receptacle cavity 2 of the connector 1 onto which the faceplate is mounted. The height of the housing member between the walls 66 will interfit across the inner dimension of the opening 92'. The latch 74 will latch behind the flange 24, preventing withdrawal of the module 94' from the opening 92'. Only a single latch is required. The keys 98' align the module 94' without a need to support the module walls 64. Plural modules 94' may be placed side to side in abutting relationship without blocking any of the closely spaced terminals of the connector 1 from contact by terminals of a respective plug member 32.

Although a preferred embodiment of the invention is disclosed and described in detail, other embodiments and modifications thereof which will be apparent to one having ordinary skill in the art are intended to be covered by the spirit and scope of the appended claims.

What is claimed is:

1. A kit of parts for tapping selected receptacle contacts of a receptacle connector terminated to individual conductors of a telephone cable, comprising:

a face plate having one or a plurality of plug receiving openings for mounting over a plug receiving cavity of a receptacle connector containing multiple pairs of receptacle contact terminals, a plug insertable through a selected said plug receiving opening and into a portion of said plug receiving cavity, said plug having one or more pairs of plug contact terminals for frictionally engaging respective said receptacle contact terminals, said plug contact terminals having slotted plate portions for connection to insulated conductors and a housing for enclosing said plug and for retaining said insulated conductors in said slotted plate portions, said housing latching to said face plate.

2. The structure as recited in claim 1, and further including: a telephone jack having jack contact terminals connected to insulated conductor leads, and said leads being terminated to said slotted plate portions of said plug contact terminals.

3. The structure as recited in claim 2, and further including:

an enclosure box for enclosing said receptacle connector, said module, said leads, and said telephone jack, said box being provided with a first opening for mounting said jack, and a second opening for receiving therethrough a telephone cable having multiple insulated wires connected to respective said receptacle contact terminals.

4. The structure as recited in any one of claims 1 to 3 in which the housing is open ended, walls of the housing being formed with a rearwardly projecting latching finger for engaging behind an end wall of the plug when enclosed by the housing and a forwardly projecting latching arm for engaging a latching flange provided on the face plate to latch the housing to the face plate.

5. The structure as recited in claim 4 in which ribs provided in the housing engage in mouths of the slotted plate portion when the plug is enclosed by the housing.

* * * * *